United States Patent [19]

Shuster et al.

[11] Patent Number: 4,955,435

[45] Date of Patent: Sep. 11, 1990

[54] HEAT EXCHANGER FABRICATED FROM POLYMER COMPOSITIONS

[75] Inventors: Jerry P. Shuster, Oakville; Anthony J. Cesaroni, Agincourt, both of Canada

[73] Assignee: Du Pont Canada, Inc., Mississauga, Canada

[21] Appl. No.: 178,387

[22] Filed: Apr. 6, 1988

[30] Foreign Application Priority Data

Apr. 8, 1987 [GB] United Kingdom ..... 8708384
Apr. 8, 1987 [GB] United Kingdom ..... 8708385

[51] Int. Cl.[5] ..... F28F 3/14

[52] U.S. Cl. ..... 165/170; 165/905; 126/444; 126/448

[58] Field of Search ..... 165/170–175, 165/166, 133, 905; 126/426, 444, 445, 448, 450, 901, 449

[56] References Cited

U.S. PATENT DOCUMENTS

| | | | |
|---|---|---|---|
| 3,216,492 | 11/1965 | Weaver | 165/46 |
| 4,114,597 | 9/1978 | Erb | 165/170 |
| 4,146,012 | 3/1979 | Elkins | 126/444 |
| 4,206,748 | 6/1980 | Goodman et al. | 126/444 |
| 4,404,958 | 9/1983 | Boettcher | 126/444 |
| 4,411,310 | 10/1983 | Perry et al. | 165/166 |
| 4,473,064 | 9/1984 | Jacques | 126/426 |
| 4,483,325 | 11/1984 | Siemiller | 126/444 |
| 4,524,757 | 6/1985 | Buckley | 126/444 |
| 4,649,991 | 3/1987 | Neuhaus et al. | 165/905 |
| 4,763,641 | 8/1988 | Smith | 165/170 |

FOREIGN PATENT DOCUMENTS

| | | | |
|---|---|---|---|
| 0010817 | 5/1980 | European Pat. Off. | 165/905 |
| 0052321 | 5/1982 | European Pat. Off. . | |
| 0065679 | 12/1982 | European Pat. Off. | 165/905 |
| 1952785 | 4/1971 | Fed. Rep. of Germany . | |
| 2525480 | 12/1976 | Fed. Rep. of Germany . | |
| 3040987 | 5/1982 | Fed. Rep. of Germany . | |
| 3042742 | 6/1982 | Fed. Rep. of Germany . | |
| 8420082 | 7/1985 | Fed. Rep. of Germany . | |
| 3402956 | 8/1985 | Fed. Rep. of Germany | 165/170 |
| 2566107 | 12/1985 | France . | |
| 8002720 | 12/1981 | Netherlands | 165/133 |
| 1235697 | 6/1971 | United Kingdom | 165/905 |
| 1354502 | 5/1974 | United Kingdom | 165/905 |
| 2072323 | 9/1981 | United Kingdom | 126/444 |
| 1465564 | 10/1983 | United Kingdom . | |
| 2175995 | 12/1986 | United Kingdom . | |

*Primary Examiner*—James C. Yeung

[57] ABSTRACT

A panel heat exchanger is disclosed. The heat exchanger comprises a generally planar panel having a pair of relatively thin unitary outer walls formed from a composition of a thermoplastic polymer, expecially a polyamide. The walls, which have a thickness of less than 0.7 mm, are bonded together to form a labryinth of fluid passages between the walls. The passages extend between inlet and outlet means and occupy a substantial proportion of the area of the panel. The heat exchangers are relatively economical to manufacture and may be used in a variety of end uses, depending on the properties of the polymer composition, including in some instances as heat exchangers in automobiles.

3 Claims, 1 Drawing Sheet

HEAT EXCHANGER FABRICATED FROM POLYMER COMPOSITIONS

This invention relates to heat exchangers, particularly liquid to gas heat exchangers for use in vehicles.

Heat exchangers used in vehicles for transferring surplus heat from power train coolants and lubricants to the ambient air, and controlling the temperature of ambient air admitted to passenger or freight compartments of vehicles, have traditionally been of the core type. In such heat exchangers, the liquid medium is passed through multiple liquid passages in a generally planar open structure core and air is passed through the core in a direction generally perpendicular to the plane of the core. The surface area of the core is often increased by the provision of fins. The entire core assembly is constructed of thin metal, especially high conductivity metal e.g. copper or aluminum, in order to maximize the rate of heat transfer in the heat exchanger. The rate of heat transfer is further improved, and skin effects at the external metal-to-gas interface are reduced, by turbulent effects resulting from the flow of air through the radiator core, to the extent that a substantial air pressure drop will occur across a high efficiency core-type radiator operating at any major fraction of its maximum heat transfer capacity. This pressure drop, and the turbulent state of the air leaving the core, results in substantial power being dissipated in maintaining the air flow through the heat exchanger.

Proposals have been made to utilize panel type heat exchangers, in which the panel surface provides an extended heat transfer surface over which air tends to flow substantially parallel to the panel surface. Panel heat exchangers have found limited application in practice due to problems both in fabricating the panels and achieving adequate heat transfer performance. More particularly, flat panels do not of themselves induce the high degree of turbulence required to limit skin effects at the external metal-to-gas interface i.e. interface of heat exchanger and air, and provide efficient heat transfer. Moreover, such panels are expensive to fabricate in known constructions and tend to require a great deal of material compared with the cores of conventional heat exchangers.

The presently most satisfactory and widely used form of panel heat exchanger is made from roll-bonded aluminum, which has been extensively used in refrigeration equipment of the type in which heat is extracted through the walls of cooling chambers containing relatively static air. However, the walls of the fluid passages of the panel heat exchanger, and in particular the portions of the panel between the fluid passages, must be relatively thick, because of technical limitations in the roll bonding process used to fabricate such panel heat exchangers. Aluminum has a high thermal conductivity and the need to use thick walls does not exact a significant penalty in heat transfer performance, but there are disadvantages of weight, cost and inflexibility in the designing of heat exchangers.

Panel heat exchangers fabricated from polymers are known e.g. the rectangular panel heat exchangers described in published French Pat. application No. 2,566,107 of J.E. Borghelot et al, published 1985 Dec. 20. Such panels have a serpentine passage defined by convex channels mutually opposed on opposite sides of the parting line of the panel, and are manufactured by an extrusion/blow moulding process.

It has now been found that panel heat exchangers may be fabricated from polymers, thereby providing potential savings in both cost of fabrication and in weight. In addition, it has been found that the heat performance of panel type heat exchangers may be markedly improved by operating the exchanger within and parallel to a streamline flow of air, whilst inducing microturbulence in the air immediately adjacent the panel surfaces so as to break up the boundary layer without disturbing the overall streamline flow. Such heat exchangers have effective heat exchange characteristics whilst greatly reducing the power losses associated with the pressure drop and turbulent air flow through a conventional core-type heat exchanger. It has also been appreciated that in such heat exchangers, effects at the interfaces between the heat exchange fluids, particularly the polymer/air interface, may be more significant than the thermal conductivity of the polymer; at the wall thicknesses disclosed herein, the thermal conductivity may become an insignificant factor.

Accordingly, the present invention provides a panel heat exchanger comprising a generally planar panel having a pair of unitary outer walls formed from a composition of a thermoplastic polymer, said walls being bonded together to define a labyrinth of fluid passages therebetween, such passages extending between inlet and outlet header areas and occupying a substantial proportion of the area of the panel.

The present invention also provides a process for the dissipation of heat from a fluid, comprising feeding said fluid to the inlet of a panel heat exchanger as described herein, passing a second fluid over the outer surface of the heat exchanger, said second fluid having a temperature less than that of the first fluid, and withdrawing fluid so cooled from the outlet of the panel heat exchanger.

In a preferred embodiment of the panel heat exchanger of the present invention, the outer walls have a thickness of less than 0.7 mm.

In a further embodiment, the thermoplastic polymer is a polyamide.

In another embodiment, the thickness of the outer walls is at least 0.12 mm.

The invention is further described herein with particular reference to the embodiments shown in the drawings, in which.

Figure 1:
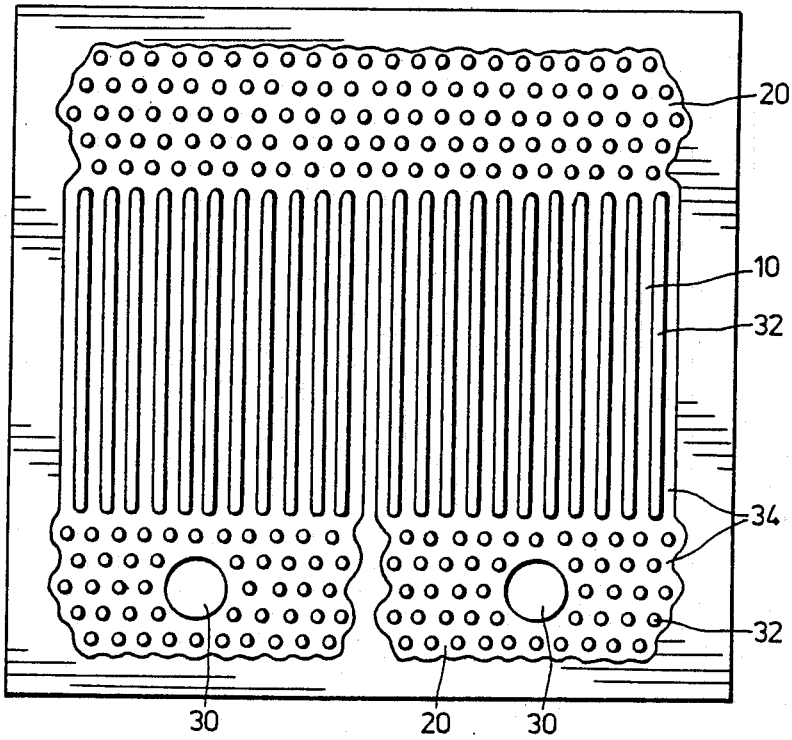
FIG. 1 is a plan view of a panel heat exchanger of the present invention.
Figure 2:
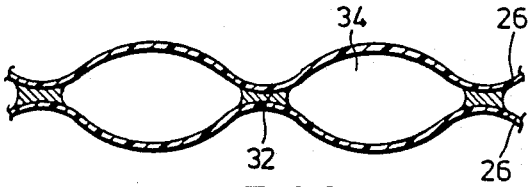
FIG. 2 is a fragmentary section through part of a panel heat exchanger.
Figure 3:
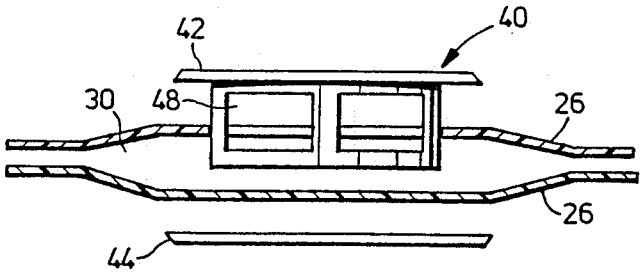
FIG. 3 illustrates a fluid connection device for the panel heat exchangers of the invention.

A panel heat exchanger may be formed from two opposed sheets 26 of a composition of a thermoplastic polymer, as shown in FIG. 2. At least one of sheets 26 is formed with a pattern of recesses such that, in the fabricated heat exchanger, fluid-flow passages interspersed with bonded zones 32 are formed. The fluid-flow passages 34 and bonded zones 32 are shown in plan view in FIG. 1 as forming a labyrinth, of fluid-flow passages through channels 10 and header areas 20.

In FIG. 1, the header areas 20 are shown having bonded zones 32 in the form of circular islands. However, the islands may be of any convenient shape, including hexagonal, diamond-shaped or the like. Header areas 20 have fluid-flow passages 34 around the islands. The header areas are interspersed with fluid-flow passages through channels 10. All of the fluid-flow passages 34 of the heat exchanger in combination form a labyrinth of fluid-flow passages in the panel heat exchanger.

FIG. 1 shows a labyrinth of fluid-flow passages formed by circular islands and channels. It is to be understood that the proportion of the panel heat exchanger having islands and having channels may be varied, including an embodiment of a panel heat exchanger having only islands. In addition, indentations or projections, or the like, not shown, may be placed in the spaces between the islands to cause turbulence in the flow of fluid through the fluid-flow passages of the heat exchanger, which tends to improve heat transfer characteristics of the panel heat exchanger.

Various methods may be used to form the sheets 26, depending on the polymer composition and the envisaged scale of production. Thus the sheets may, for example, be formed in a press or thermoformed. Several types of differential pressure thermoforming may be utilized, including vacuum or air pressure forming. The fabrication techniques used will depend in particular upon the polymer composition utilized and the configuration required. Thermosetting materials may be formed and cured using male, female or matched moulds, with or without the use of heat and pressure, as appropriate to the material being used.

One or both of the sheets 26 may be formed with the recesses corresponding to fluid-flow passages 34. After forming, the sheets are bonded together using, for example, adhesive bonding or welding using heat sealing or other appropriate techniques.

In an embodiment of the methods for the fabrication of the panel heat exchangers of the invention, a bonding agent is printed onto one panel in the pattern of the portions of the panels that are to be bonded. Bonding is effected by applying heat and/or pressure, preferably in conjunction with pressure of an inert gas being applied to expand the fluid-flow passages; use of moulds having a recessed pattern corresponding to the fluid-flow passages tends to facilitate the formation of the passages.

In another embodiment, which is disclosed in the copending application of A. Cesaroni and J.P. Shuster filed simultaneously herewith, one or both of sheets 26 may be treated with a pattern of resist material. In that method, the resist material locally prevents bonding of the sheets. The untreated areas of the sheets are then bonded together using heat and pressure, a bonding material, or any other technique that will securely bond the untreated areas without causing bonding of the treated areas. The unbonded areas are then inflated, e.g. by application of gas pressure to the fluid-flow passages, including by decomposing a blowing compound applied to the treated areas so as to inflate the unbonded areas and thereby form the labyrinth of passages.

An intermediate metal or polymer layer may be introduced between the sheets 26 so as, for example, to improve the stiffness of the assembly. A perforated or open mesh layer will not prevent the layers 26 being securely welded to one another through the perforations or meshes, whilst the same perforations or meshes will increase turbulence in fluid passing through the fluid-flow passages 34, and the material of the mesh, if formed from a metal with high thermal conductivity, will improve heat transfer through the layers 26 in areas not adjacent a fluid-flow passage 34.

In an example of the external connection of fluid pipes to the panel of FIG. 1, apertures 30 are cut or formed in opposite portions of the sheets 26 in header areas 20. A collar 40 with apertures 48 is inserted and welded to both sheets 26. The collar is preferably formed with an integral peripheral flange 42 at one end which may be adhered or preferably welded to one sheet 26. A separately formed flange 44 is welded or adhered to the other end of the collar and to the other sheet 26. An apertured feed pipe may then be passed through the collar so that its apertures are aligned with the collar, and clamped in place in fluid tight relationship to the collar, which sustains the clamping forces.

The invention has been particularly described with reference to the drawings. It is to be understood, however, that the panel heat exchanger may be of the shape shown in the figures or be linear or any other convenient shape for the intended end-use.

In an alternative form of construction, an area of a panel containing parallel passages similar to the passages 10 is formed as a continuous extrusion, and the header zones are formed separately and welded or otherwise bonded to opposite ends of lengths of that extrusion.

The polymer composition used for forming the heat exchanger will usually be of relatively high thermal resistance, but at the thicknesses used according to the present invention, thermal conductivity or thermal resistance tends to be a minor or even insignificant factor in the performance of the resultant heat exchanger. The polymer must, however, be selected so that at the thickness used in the fabrication of the heat exchanger, the resultant heat exchanger has sufficient tensile strength at the maximum working temperature of the heat exchanger to withstand the maximum working pressure of the fluid within the panel without rupture or short or long term distoration. Furthermore, it must withstand prolonged contact with the working fluids of the heat exchanger without degradation, as well as being resistant to contaminants which may occur in the working environment. It should also be fatigue resistant, have a low creep modulus, provide a sufficiently rigid panel structure, and preferably be impact resistant. Clearly the actual choice of polymer composition will depend to a large extent upon the working environment and the fabrication process utilized.

A wide variety of polymers are potentially useful in the fabrication of the panel heat exchangers of the present invention. The selection of such polymers will depend on a number of factors, as discussed above, in order to obtain a heat exchanger with the properties required for operation under a particular set of operating conditions.

Examples of polymers include polyethylene, polypropylene, polyamides, polyesters, polycarbonates, polyphenylene oxide, polyphenylene sulphide, polyetherimide, polyetheretherketone, polyether ketone, polyimides, polyarylates and high performance engineering plastics. Such polymers may contain stabilizers, pigments, fillers and other additives known for use in polymer compositions. The nature of the polymer composition used may affect the efficiency of the heat exchanger, as it is believed that heat is capable of being dissipated from the heat exchanger by at least both convection and radiation.

In a particularly preferred embodiment of the present invention, the polymer is a polyamide, examples of which are the polyamides formed by the condensation polymerization of an aliphatic or aromatic dicarboxylic acid having 6–12 carbon atoms with an aliphatic primary diamine having 6–12 carbon atoms. Alternatively, the polyamide may be formed by condensation polymerization of an aliphatic lactam or alpha, omega aminocarboxylic acid having 6–12 carbon atoms. In addition, the polyamide may be formed by copolymerization of mixtures of such dicarboxylic acids, diamines, lactams and aminocarboxylic acids. Examples of dicarboxylic acids are 1,6-hexanedioic acid (adipic acid), 1,7-heptanedioic acid (pimelic acid), 1,8-octanedioic acid (suberic acid), 1,9-nonanedioic acid (azelaic acid), 1,10-decanedioic acid (sebacic acid), 1,12-dodecanedioic acid and terephthalic acid. Examples of diamines are 1,6-hexamethylene diamine, 1,8-octamethylene diamine, 1,10-decamethylene diamine and 1,12-dodecamethylene diamine. An example of a lactam is caprolactam. Examples of alpha,omega aminocarboxylic acids are amino octanoic acid, amino decanoic acid and amino dodecanoic acid. Preferred examples of the polyamides are polyhexamethylene adipamide and polycaprolactam, which are also known as nylon 66 and nylon 6, respectively.

The polymer may be a filled and/or toughened polymer, especially where the polymer is a polyamide. In embodiments, the filler is glass fibre and/or the polymer has been toughened with elastomeric or rubbery materials, especially where the elastomeric or rubbery materials are well dispersed within the polymer matrix but tend to remain in the form of a second phase. Alloys and/or blends of polymers, especially alloys and/or blends of polyamides may also be used.

In an embodiment of the present invention, the polyamide may be a so-called amorphous polyamide. The amorphous polyamide may be used as the sole polyamide, or admixed with another polymer e.g. a polyamide of the type disclosed above.

As will be appreciated by those skilled in the art, the polyamides described above exhibit a wide variety of properties. For instance, melting points of polymers of dicarboxylic acid/diamine polymers will differ significantly from polymers of lactams or alpha, omega aminocarboxylic acids and from copolymers thereof. Similarly, other properties e.g. permeability to fluids, gases and other materials will also vary. Thus, even if the polymer selected is polyamide, a particular polyamide may have to be selected from a particular end use.

Laminated or coated materials may also be used. Such materials could comprise a layer providing the necessary physical resistance and inner and/or outer layers to provide resistance to the working fluids or contaminants. An inner layer may be selected to provide, as well as chemical resistance, improved bonding properties with the opposite layer. The laminate may include the fabric layer, woven for example from monofilament nylon, bonded to an inner layer providing impermeability to fluids and a bonding medium. The weave pattern of such a fabric outer layer may be utilized to assist in providing advantageous surface microturbulence. Such a fabric reinforcing layer need not necessarily be fabricated from synthetic plastic; a metal foil or fabric layer could be utilized and would provide an extended heat transfer surface having good heat conductivity. Techniques for the manufacture of multilayered polymer structures are know to those skilled in the art, including coating, laminating and calendering.

In preferred embodiments, the panel heat exchangers of the present invention have wall thicknesses, at least in those portions where transfer of heat will occur, of less than 0.7 mm, and especially in the range of 0.12–0.5 mm, particularly 0.15–0.4 mm. At such wall thicknesses, the transmission of heat through the wall tends to become substantially independent of wall thickness, and thus wall thickness may become a minor or insignificant factor in the operating effectiveness of the heat exchanger. It is to be understood, however, that the polymer composition and the wall thickness must be selected so that the resultant heat exchanger will have the necessary physical properties to be acceptable for the intended end use, as discussed above.

The panel heat exchangers of the present invention may potentially be used in a wide variety of end uses. For example, the heat exchangers may be used in vehicles, as discussed above. However, the exchangers may find use in refrigerators and other heating or cooling systems. The polymer may be selected so as to be relatively transparent to transmission of radiation over all or part of the electromagnetic spectrum e.g. the ultra violet, visible, infra red and longer wavelengths.

The present invention is illustrated by the following examples:

EXAMPLE I

A panel heat exchanger of the type shown in FIG. 1 and described hereinabove was formed from polyhexamethylene adipamide sheet having a thickness of about 0.25 mm. In addition, a panel heat exchanger of similar design was formed from aluminum sheet having a thickness of about 0.63 mm. The heat exchangers were of similar size and surface area.

The two heat exchangers were tested to determine their relative effectiveness as heat exchangers using the following procedure: a heat exchanger was connected to a pump, a means to determine the rate of flow of liquid through the heat exchanger and to a source of heated water. The heated water was pumped through the heat exchanger. The temperature of the water was measured both immediately prior to and immediately after being passed through the heat exchanger.

A stream of air was passed over the surfaces of the heat exchanger. The temperature of the air was measured both immediately prior to and immediately after being passed over the surface of the heat exchanger.

Water was passed through the heat exchangers at three different rates viz. about 6.2, 14.2 and 40 litres/minute. In addition, a range of rates of air flow over the surfaces of the heat exchangers was used, from about 40 m/minute to about 120 m/minute.

It was found that at the lower rates of flow of water, the polyhexamethylene adipamide (plastic) heat exchanger was approximately 89% as efficient as the aluminum heat exchanger at low rates of air flow and 84% as efficient at the higher rates. At the highest rate of water flow, the plastic heat exchanger was about 71% and 87% as effective as the aluminum heat exchanger at the low and high air flow rates, respectively.

This example shows that effective panel heat exchangers may be manufactured from polymeric material, especially polyamides.

EXAMPLE II 2 g of benzyl alcohol were admixed with 10 g of phenol and heated to 100° C. A polyamide (polyhexamethylene adipamide), 2 g, in flake form was then added to the admixture and stirred until the polyamide had dissolved. The resultant homogeneous admixture was then cooled to ambient temperature; the admixture obtained appeared to be homogeneous and had a viscosity similar to liquid honey.

The admixture was coated onto a polyamide (polyhexamethylene adipamide) in the form of film. The coated film was contacted with a similar polyamide film that had been coated with the pattern of a labyrinth of the type shown in FIG. 1. The resist coating applied as the pattern was polyvinyl alcohol. The resultant film combination was placed in a platen press at a temperature that varied between 120 and 190° C.

The laminate obtained was cooled and then tested. It was found that a strong bond had been formed between the films at the locations where the polyvinyl alcohol had not been coated onto the film.

EXAMPLE III

The procedure of Example II was repeated using panels formed from polycarbonate, instead of polyamide. One polycarbonate film was coated with polyvinyl alcohol in the pattern of the labryinth, while the other polycarbonate film was uncoated i.e. a coating of benzyl alcohol/phenol/polymer was not applied to the film. The resultant film combination was placed in the platen press.

It was found that a strong bond was formed between the films in the locations where polyvinyl alcohol had not been coated on the film.

EXAMPLE IV

Using the procedure of Example I, a number of experiments were conducted to compare the efficiencies of panel heat exchangers formed from aluminum with panel heat exchangers formed from polyhexamethylene adipamide sheets of differing thicknesses.

In the experiments, the ambient air temperature was 24° C. and the inlet temperature of the water being fed to the heat exchangers was 96° C. The flow rate was approximately 1 liter/minute.

Using the temperature of the water passing from the heat exchanger, the rate of removal of heat from the water was calculated for the polyamide heat exchangers and plotted against wall thickness of the walls of the polyamide sheets forming the heat exchanger. The resultant graph showed that at, under the conditions used in the experiments, the aluminum and polyamide heat exchangers were of the same efficiency when the thickness of the polyamide sheets was 0.25–0.28 mm. At a wall thickness of 0.36 mm, the polyamide heat exchanger was only about 91% as efficient as the aluminum heat exchanger, but at 0.20 and 0.15 mm wall thicknesses, the polyamide heat exchanger was 108 and 117% as efficient as the aluminum heat exchanger.

Thus, panel heat exchangers may be fabricated from polymers, especially polyamides, so as to have higher heat exchange efficiencies than aluminum heat exchangers.

EXAMPLE V

The procedure of Example III was repeated using colloidal graphite as a resist coating i.e. the polycarbonate was coated with graphite in the pattern of the labyrinth.

After pressing in a heated platen press, it was found that a strong bond was formed between the films in the locations where the graphite had not been coated on the film.

What is claimed is:

1. A panel heat exchanger comprising a generally planar panel having a pair of unitary outer walls of a thickness in the range of 0.12–0.50 mm and formed from a composition of aliphatic polyamide, said unitary outer walls being circumferentially bonded together and further said unitary outer walls being bonded together to define inlet and outlet header areas and a labyrinth of fluid passages extending between the inlet and outlet header areas, said fluid passages occupying a substantial proportion of the area of the panel.

2. The panel heat exchanger of claim 1 in which said outer walls are moulded with channels defining said labyrinth of fluid passages prior to bonding to the other outer wall.

3. The panel heat exchanger of claim 1 in which the outer walls have a thickness of 0.15 to 0.4 mm.

* * * * *